US011441577B2

(12) United States Patent
Shaffer et al.

(10) Patent No.: US 11,441,577 B2
(45) Date of Patent: Sep. 13, 2022

(54) APPARATUS FOR TRANSFERRING PRESSURIZED FLUID IN A BACK-TO-BACK MULTI-STAGE PUMP

(71) Applicant: Curtiss-Wright Electro-Mechanical Corporation, Cheswick, PA (US)

(72) Inventors: Ronald J. Shaffer, Pittsburgh, PA (US); Matthew D. Van Orden, New Kensington, PA (US)

(73) Assignee: CURTISS-WRIGHT ELECTRO-MECHANICAL CORPORATION, Cheswick, PA (US)

( * ) Notice: Subject to any disclaimer, the term of this patent is extended or adjusted under 35 U.S.C. 154(b) by 0 days.

(21) Appl. No.: 17/162,127

(22) Filed: Jan. 29, 2021

(65) Prior Publication Data

US 2021/0246907 A1 Aug. 12, 2021

Related U.S. Application Data

(60) Provisional application No. 62/970,974, filed on Feb. 6, 2020.

(51) Int. Cl.
*F04D 29/44* (2006.01)
*F04D 1/06* (2006.01)

(52) U.S. Cl.
CPC ..... *F04D 29/44* (2013.01); *F04D 1/06* (2013.01)

(58) Field of Classification Search
CPC ..... F04D 1/06; F04D 1/066; F04D 29/44; F04D 29/444; F04D 29/448; F04D 17/122
See application file for complete search history.

(56) References Cited

U.S. PATENT DOCUMENTS 3,232,235 A * 2/1966 Pilarczyk ..... F04D 15/0072 415/140
3,788,764 A * 1/1974 Shuey ..... F04D 29/42 415/199.3
2010/0068031 A1* 3/2010 Marcelli ..... F04D 29/126 415/104
2015/0330391 A1 11/2015 Bergamini et al.

FOREIGN PATENT DOCUMENTS

CN 105697382 A 6/2016

OTHER PUBLICATIONS

Extended European Search Report dated Jun. 22, 2021 for Corresponding European Application No. 21154991.0.

* cited by examiner

*Primary Examiner* — Topaz L. Elliott
*Assistant Examiner* — Jackson N Gillenwaters
(74) *Attorney, Agent, or Firm* — Pearne & Gordon LLP

(57) ABSTRACT

A multi-stage pump includes a first set of pump stages directing fluid in a first direction from a first end of the multi-stage pump to a diffuser casing disposed at a central portion of the multi-stage pump. A second set of pump stages directs the fluid expelled from the diffuser casing in a second direction, opposite to the first direction, from a second end of the multi-stage pump to the diffuser casing. The diffuser casing receives the fluid from the first set of pump stages and directs the fluid toward the second end of the multi-stage pump and receives the fluid from the second set of pump stages and directs the fluid in a radial direction with respect to a longitudinal axis of the multi-stage pump.

16 Claims, 7 Drawing Sheets

APPARATUS FOR TRANSFERRING PRESSURIZED FLUID IN A BACK-TO-BACK MULTI-STAGE PUMP

FIELD OF THE INVENTION

This application relates generally to a multi-stage pump, and more particularly, to a method and apparatus for transferring pressurized fluid in a back-to-back multi-stage pump.

BACKGROUND OF THE INVENTION

Conventional means for directing pressurized fluid in a multi-stage pump typically include a plurality of impeller stages, wherein a first half of the plurality of impeller stages directs the fluid in a first direction and a second half of the plurality of impeller stages directs the fluid in a second direction, opposite to the first direction. This configuration successfully balances thrust concerns between the first and second halves of the plurality of impeller stages. However, with respect to known, conventional configurations, it is difficult to effectively direct the flow of fluid from the first half of the plurality of impeller stages to the second half, and to subsequently direct the flow from the second half of the plurality of impeller stages out of the pump (e.g., to a working environment).

One such conventional configuration employs additional tubing to externally route the fluid. For example, the fluid directed from the first half of the plurality of impeller stages is expelled outside of a housing of the multi-stage pump via an external tube. The external tube directs the fluid back into the housing at a location were the second half of the plurality of impeller stages resides. From there, the second half of the plurality of impeller stages directs the fluid to a downstream location where the fluid is expelled out of the multi-stage pump to a working environment. This known configuration requires additional parts (e.g., the external tube) and increases manufacturing complexity.

BRIEF SUMMARY OF THE INVENTION

In accordance with one aspect, there is provided a multi-stage pump having a first set of pump stages directing fluid in a first direction from a first end of the multi-stage pump to a diffuser casing disposed at a central portion of the multi-stage pump. A second set of pump stages directs the fluid expelled from the diffuser casing in a second direction, opposite to the first direction, from a second end of the multi-stage pump to the diffuser casing. The diffuser casing receives the fluid from the first set of pump stages and directs the fluid toward the second end of the multi-stage pump and receives the fluid from the second set of pump stages and directs the fluid in a radial direction with respect to a longitudinal axis of the multi-stage pump.

In accordance with another aspect, there is provided a multi-stage pump comprising an outer housing having an inlet and an outlet. A first set of pump stages is disposed at a first end of the outer housing for directing fluid in a first direction from the inlet of the outer housing to a central portion of the outer housing. A second set of pump stages is disposed at a second end of the outer housing, the second end being opposite to the first end of the outer housing. The second set of pump stages directs the fluid in a second direction, opposite to the first direction, from the second end of the multi-stage pump to the central portion of the outer housing.

The multi-stage pump further includes a diffuser disposed in the central portion of the outer housing at a location between the first set of pump stages and the second set of pump stages. The diffuser casing comprises an outer circumferential passage that extends in a longitudinal direction through the diffuser for directing fluid in the longitudinal direction from an outlet end of the first set of pump stages to an inlet end of the second set of pump stages. An inner passage extends in a radial direction through the diffuser for directing fluid exiting an outlet end of the second set of pump stages in a direction tangential to the direction fluid flows through the outer circumferential passage. The fluid flowing in the inner passage is directed radially away from the diffuser.

In accordance with yet another aspect, there is provided a multi-stage pump comprising a first set of pump stages directing fluid in a first direction from a first end of the multi-stage pump to a central portion of the multi-stage pump, wherein the first direction is parallel to a longitudinal axis of the multi-stage pump. The multi-stage pump further includes a second set of pump stages directing the fluid in a second direction, opposite to the first direction, from a second end of the multi-stage pump to the central portion. A diffuser casing is disposed at the central portion and includes a first inlet that receives the fluid directed from the first set of pump stages, a first outlet that expels the fluid received by the first inlet, a second inlet that receives the fluid directed from the second set of pump stages, and a second outlet that directs the fluid to a chamber within the diffuser casing. An outer housing encases the first set of pump stages, the second set of pump stages, and the diffuser casing.

The diffuser casing further includes a first casing and a second casing. The first casing has a first vane that defines a first internal passage from the first inlet to the first outlet. The second casing has a second vane that defines a second internal passage from the second inlet to the second outlet. A through-hole is formed in the first vane. The through-hole directs the fluid in a radial direction with respect to the longitudinal axis of the multi-stage pump and expels the received fluid to an outside chamber of the diffuser casing. A reservoir is defined as a space between an inner surface of the outer housing and an outer surface of the second set of pump stages, and wherein the reservoir directs the fluid expelled from the first outlet to the second end of the multi-stage pump.

DESCRIPTION OF EXAMPLE EMBODIMENTS

Figure 1:
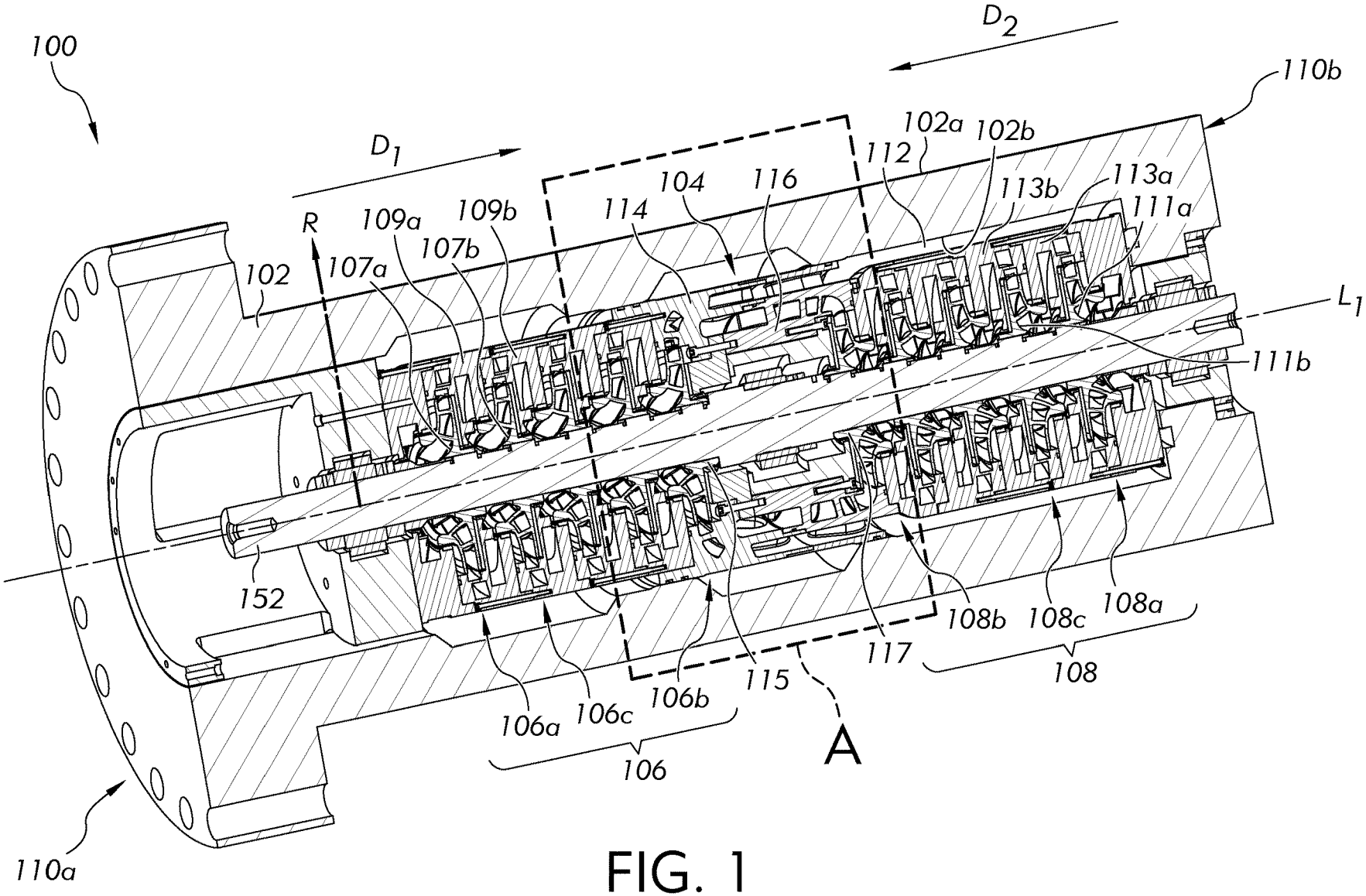
FIG. 1 is a perspective, cross-sectional view of a multi-stage pump, according to the present invention, taken along a longitudinal axis of the multi-stage pump.

Referring now to the drawings, FIG. 1 depicts a perspective, cross-sectional view of a multi-stage pump 100 taken along a first longitudinal axis $L_1$ thereof. The multi-stage pump 100 includes an outer housing 102 defining an inner space configured to receive and encase a diffuser casing 104 disposed longitudinally between a first set of pump stages 106 and a second set of pump stages 108. In the depicted embodiment, the outer housing 102 is formed in the shape of a hollow cylinder (half of the outer housing 102 is shown in FIG. 1). That is, an outer surface 102*a* of the outer housing 102 has a generally circular shape in a cross-sectional view taken perpendicular to the first longitudinal axis $L_1$. Similarly, an inner surface 102*b* of the outer housing 102 (i.e., the inner surface 102*b* that delimits the inner space of the outer housing 102) likewise has a generally circular shape in the cross-sectional view taken perpendicular to the first longitudinal axis $L_1$. As can be appreciated, the inner surface 102*b* may be contoured to have features, e.g., recesses, cavities, steps, ledges, etc. for mating with components that are mounted in the inner space of the outer housing 102.

It is to be understood that the geometric configuration of the outer housing 102 is not limited to a hollow cylinder. For example, the outer and inner surfaces 102*a*, 102*b* of the outer housing 102 can have a shape in the cross-sectional view taken perpendicular to the first longitudinal axis $L_1$ other than circular (e.g., square, rectangular, triangular, etc.). Further still, the outer and inner surfaces 102*a*, 102*b* of the outer housing can have different shapes, with respect to one another, in the cross-sectional view taken perpendicular to the first longitudinal axis $L_1$. For example, the outer and inner surfaces 102*a*, 102*b* can have rectangular and circular shapes, respectively, in the cross-sectional view taken perpendicular to the first longitudinal axis $L_1$.

As further shown in FIG. 1, the outer housing 102 extends longitudinally (i.e., along the first longitudinal axis $L_1$) from a first end 110*a* to a second end 110*b*. The diffuser casing 104 is disposed within the inner space of the outer housing 102 at a central portion thereof, with respect to the first and second ends 110*a*, 110*b*. As briefly mentioned above, the diffuser casing 104 is positioned between the first set of pump stages 106 and the second set of pump stages 108. In this manner, the first set of pump stages 106 is disposed between the first end 110*a* of the outer housing 102 and the diffuser casing 104, and the second set of pump stages 108 is disposed between the diffuser casing 104 and the second end 110*b* of the outer housing 102, with respect to the first longitudinal axis $L_1$. As such, the multi-stage pump 100 has a back-to-back configuration wherein each of the first and second sets of pump stages 106, 108 includes multiple pump stages disposed directly adjacent to one another, and wherein the first and second sets of pump stages 106, 108 are in fluid communication with one another.

As will be further detailed below, the multi-stage pump 100 is configured such that the first set of pump stages 106 directs a fluid in a first direction D1 from the first end 110*a* of the outer housing 102 to one end of the diffuser casing 104 and the second set of pump stages 108 directs fluid expelled from the diffuser casing 104 in a second direction D2 from the second end 110*b* of the outer housing 102 to an opposite end of the diffuser casing 104. Specifically, the first and second directions D1, D2 are parallel to the first longitudinal axis $L_1$ and are opposite to one another. For example, as shown, the first direction D1 is the direction from the first end 110*a* to the second end 110*b* of the outer housing 102, along the first longitudinal axis $L_1$, and the second direction D2 is the direction from the second end 110*b* to the first end 110*a* of the outer housing 102, along the first longitudinal axis $L_1$.

Moreover, as will be further detailed below, the diffuser casing 104 is configured to receive the fluid from the first set of pump stages 106 and direct the fluid toward the second end 110*b* of the outer housing 102. Specifically, the fluid is directed from the diffuser casing 104 to the second end 110*b* of the outer housing 102 via a reservoir 112. The reservoir 112 is defined as a space between the inner surface 102*b* of the outer housing 102 and an outer surface 108*a* of the second set of pump stages 108. More specifically, the reservoir 112 extends longitudinally between the diffuser casing 104 and the second end 110*b* of the outer housing 102. In this manner, the reservoir 112 receives fluid expelled from the diffuser casing 104 and directs the expelled fluid toward the second end 110*b* of the outer housing 102.

When the fluid reaches the second end 110*b* of the outer housing 102, the fluid is received by the second set of pump stages 108, which directs the fluid (in the second direction D2) back to the diffuser casing 104. The diffuser casing 104 is further configured to receive the fluid from the second set of pump stages 108. The fluid received from the second set of pump stages 108 is then directed via the diffuser casing 104 in a radially outward direction R (i.e., a radial direction with respect to the first longitudinal axis $L_1$ of the outer housing 102) away from the multi-stage pump 100.

Individual components of the multi-stage pump 100 will now be structurally discussed in detail. Thereafter, the overall assembly and functionality of the multi-stage pump 100 will be explained with reference to a method of transferring pressurized fluid in the multi-stage pump 100.

Figure 6:
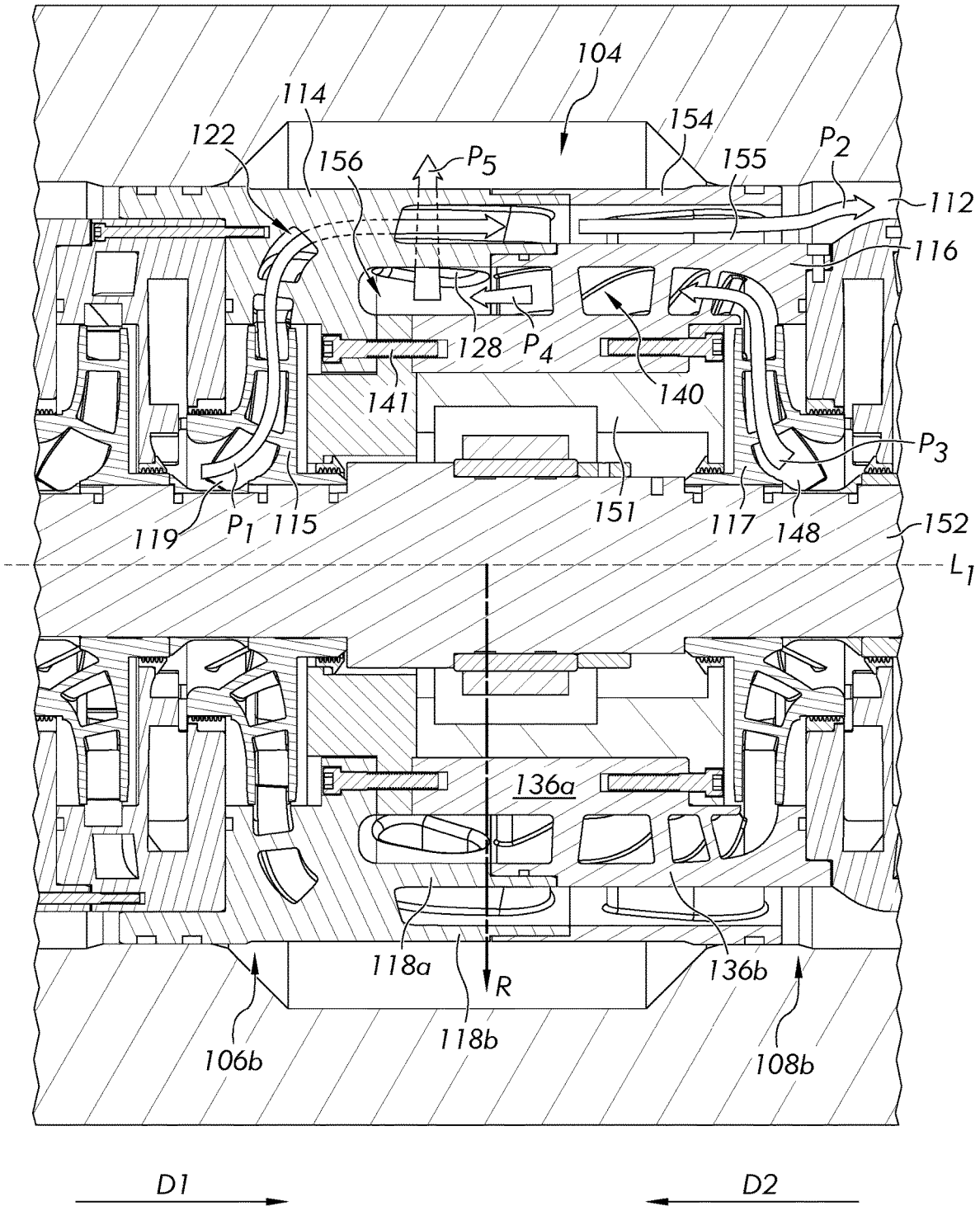
FIG. 6 is an enlarged view of a central portion of the multi-stage pump of section "A" in FIG. 1.

As shown in FIG. 6, which is an enlarged view of the central portion of the multi-stage pump 100 (encircled in dashed line "A" in FIG. 1), the diffuser casing 104 includes a first casing 114 and a second casing 116. The first casing 114 of the diffuser casing 104 is configured to at least partially, peripherally surround an outlet impeller 115 of the first set of pump stages 106 (shown in FIG. 1) and the second casing 116 of the diffuser casing 104 is configured to at least partially, peripherally surround an outlet impeller 117 of the second set of pump stages 108 (shown in FIG. 1).

Figure 2:
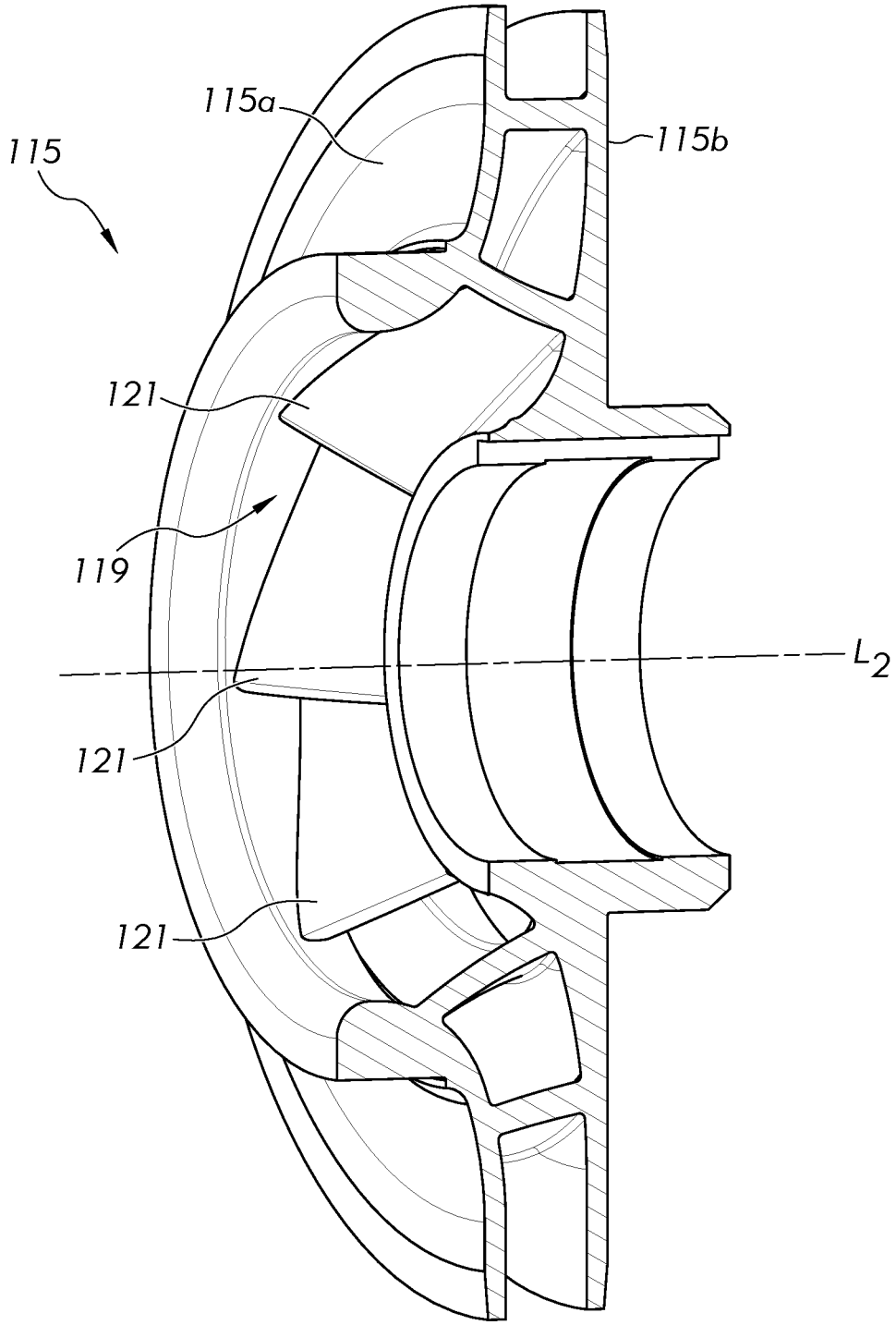
FIG. 2 is perspective, cross-sectional view of a first impeller shown in FIG. 1.

As best shown in FIG. 2, the outlet impeller 115 has a second longitudinal axis $L_2$ extending through a central opening of the outlet impeller 115. When the outlet impeller 115 is positioned in the outer housing 102, the second longitudinal axis $L_2$ of the outlet impeller 115 is positioned to coaxially align with the first longitudinal axis $L_1$ (as shown in FIG. 1). The outlet impeller 115 of the first set of pump stages 106 includes a first wall 115*a* and a separate second wall 115*b*. The first and second walls 115*a*, 115*b* are spaced apart from each other to define a channel 119 therebetween. A plurality of blades 121 are disposed within the channel 119 and are dimensioned and positioned to draw fluid in an axial direction (i.e., along the second longitudinal axis $L_2$) from the outlet impeller 115 and exhaust the fluid in a direction perpendicular to the second longitudinal axis $L_2$ via an outlet of the channel 119, i.e., in a direction radially outward from the second longitudinal axis $L_2$.

The overall number of blades 121 of the outlet impeller 115 of the first set of pump stages 106 may be any number. Further, it is to be understood that the outlet impeller 115 may be formed as a single piece-part or formed from separate and distinct parts that are subsequently secured thereto.

Figure 3B:
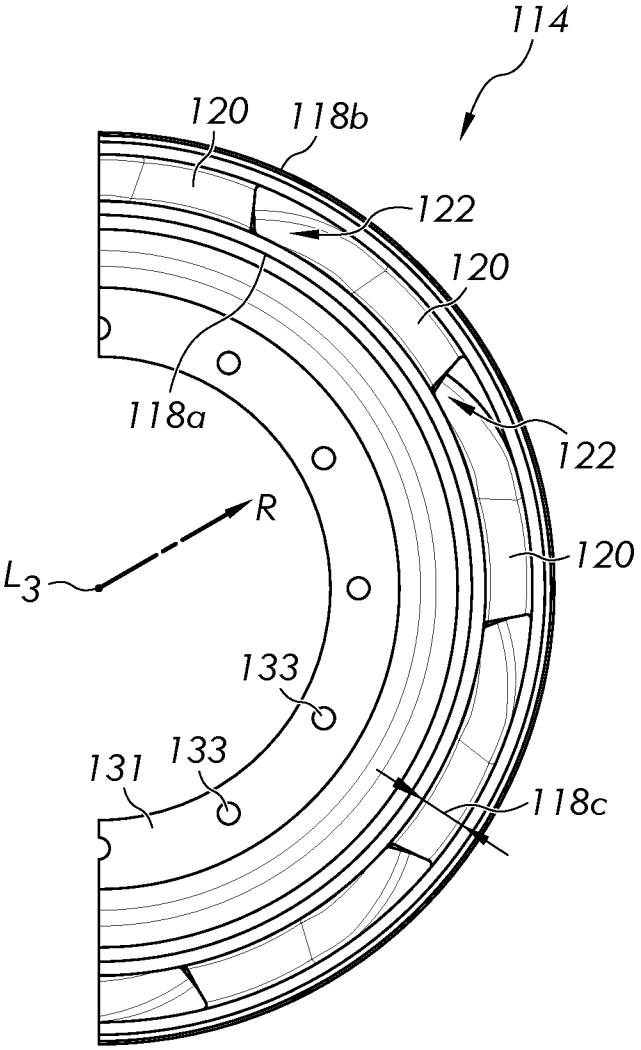
FIG. 3B is an end view of half of the first casing shown in FIG. 3A.
Figure 3A:
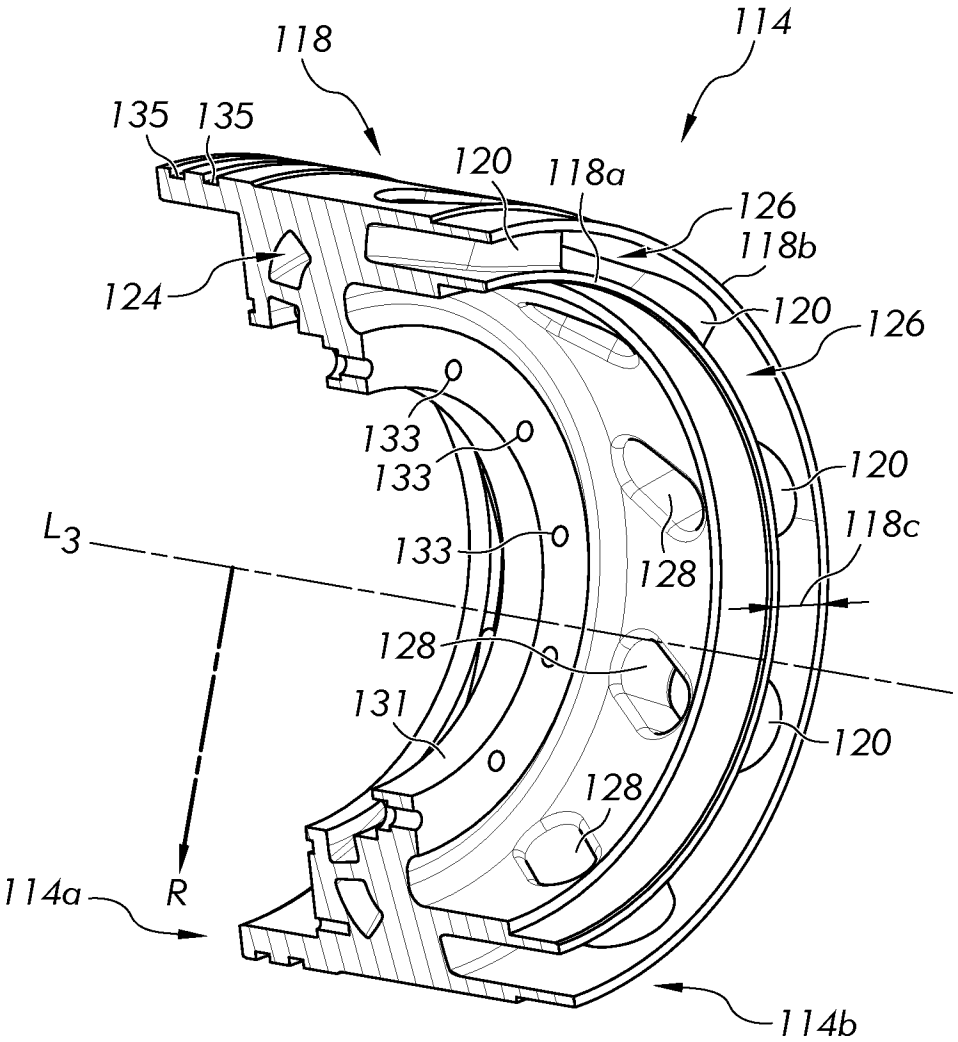
FIG. 3A is a perspective, cross-sectional view of a first casing of a diffuser casing of the multi-stage pump shown in FIG. 1.

As illustrated in FIG. 6, the first casing 114 is positioned adjacent to the outlet impeller 115 of the first set of pump stages 106. Moving now to FIGS. 3A-3C, the first casing 114 is depicted as taking the form of a hollow cylinder (only a half section of the first casing 114 is illustrated in FIGS. 3A and 3B). It is to be understood that the geometric form of the first casing 114 is not limited thereto, and that the first casing 114 may be shaped in any geometric configuration. As shown, the first casing 114 includes a circumferential wall 118 extending longitudinally along a third longitudinal axis $L_3$ from a first end 114*a* to a second end 114*b* thereof. When the first casing 114 is positioned in the outer housing 102, the third longitudinal axis $L_3$ of the first casing 114 is positioned to coaxially align with the first longitudinal axis $L_1$ (as shown in FIG. 1). Towards, the second end 114*b* of the first casing 114, the circumferential wall 118 includes an inner wall 118*a* separated and spaced apart from an outer wall 118*b* such that a gap 118*c* is formed therebetween.

Figure 3C:
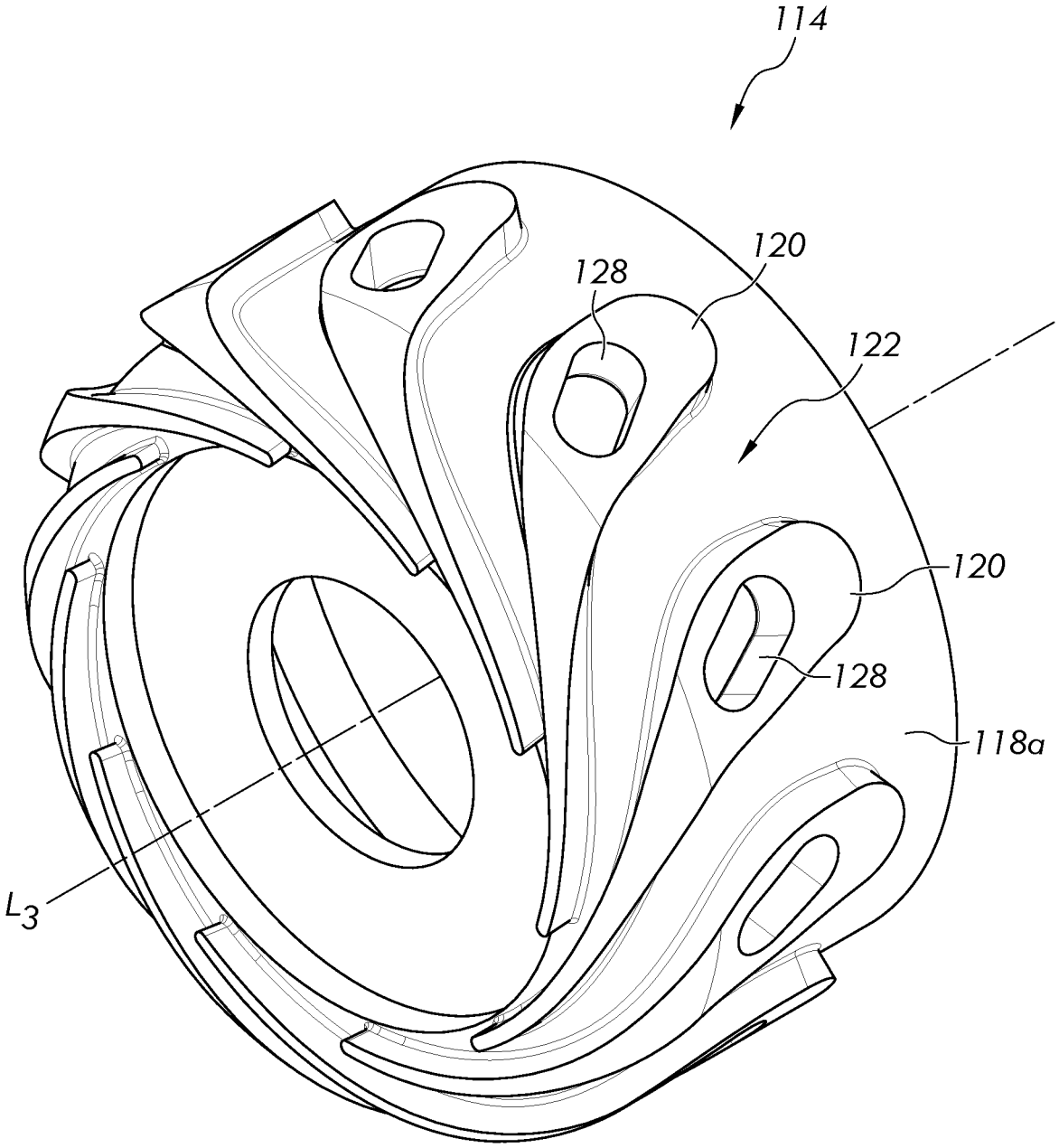
FIG. 3C is a perspective view of the first casing shown in FIG. 3A with exterior walls removed therefrom.

A plurality of first vanes 120 are positioned within the gap 118*c* and extend along the third longitudinal axis $L_3$ for drawing fluid into an annular first inlet 124 and exhausting the fluid through a peripheral first outlet 126 defined by the gap 118*c*. Specifically, the plurality of first vanes 120 extend in a curved manner about the third longitudinal axis $L_3$. The plurality of first vanes 120 are disposed within the gap 118*c* and are spaced apart from each other to define a plurality of first internal passages 122 through which fluid flows from the annular first inlet 124 to the peripheral first outlet 126. Specifically, the plurality of first internal passages 122 are defined between a pair of adjacent first vanes 120. In this manner, the plurality of first internal passages 122 are positioned within the circumferential wall 118 of the first casing 114 and are spaced circumferentially, one from the other, therein via the plurality of first vanes 120. FIG. 3C is a simplified illustration of the first casing 114 with exterior walls around the plurality of first vanes 120 removed (e.g., the outer wall 118*b*) to allow the plurality of first vanes 120 to be visible.

As described above, the first casing 114 is configured to intake fluid in the radial direction R and direct the fluid in the axial direction (i.e., along the third longitudinal axis $L_3$) via the first internal passage 122. It is to be understood that any number of first vanes 120 can be disposed with the gap 118*c* of the first casing 114 so long as at least one first internal passage 122 is defined therein. Moreover, it is to be understood that the first vanes 120 have a specific configuration that permits a pressure of fluid flowing through the first internal passages 122 to increase. Specifically, as will be further discussed below, the first vanes 120 are configured to convert the dynamic pressure, imparted to the fluid by the first set of pump stages 106, into static pressure.

As best shown in FIGS. 3A and 3C, a through-hole 128 extends through the circumferential wall 118 of the first casing 114. Specifically, a single through-hole 128 is dimensioned and positioned to extend through a single first vane 120. That is, the through-hole 128 extends through the inner wall 118*a* and the outer wall 118*b* of the circumferential wall 118 of the first casing 114 in the radial direction R of the multi-stage pump 100 and is dimensioned and positioned such that through-hole 128 is within the area bounded by the walls of the respective first vane 120. It is to be understood that the through-hole 128 extends through the first vane 120 such that the through-hole 128 is not in fluid communication with the gap 118*c* defined between the inner and outer walls 118*a*, 118*b* of the circumferential wall 118. Further, as shown, a single through-hole 128 extends through each of the first vanes 120 disposed within the gap 118*c*. However, it is to be understood that a single through-hole 128 need not extend through each of the first vanes 120. For example, the through-holes 128 may be disposed in half of the first vanes 120, or any other fraction of the first vanes 120. It is also contemplated that only a single through-hole 128 may extend through a single first vane 120. It is also contemplated that a plurality of through-holes 128 (not shown) may extend through a single first vane 120. It is to be understood that an entirety of the first casing 114 may be formed integrally, as a single piece-part or formed from a plurality of parts that are joined together.

As illustrated in FIGS. 3A and 3B, an inner flange 131 may extend from the circumferential wall 118 and include a plurality of mounting holes 133. The mounting holes 133 may be positioned and dimensioned to secure the first casing 114 to the second casing 116. An outer surface of the circumferential wall 118 may include a plurality of annular grooves 135, each dimensioned to receive a seal element, e.g., an O-ring (not shown). In this respect, when the first casing 114 is disposed in the outer housing 102 the first casing 114 sealingly engages the inner surface 102 of the outer housing 102.

Figure 4B:
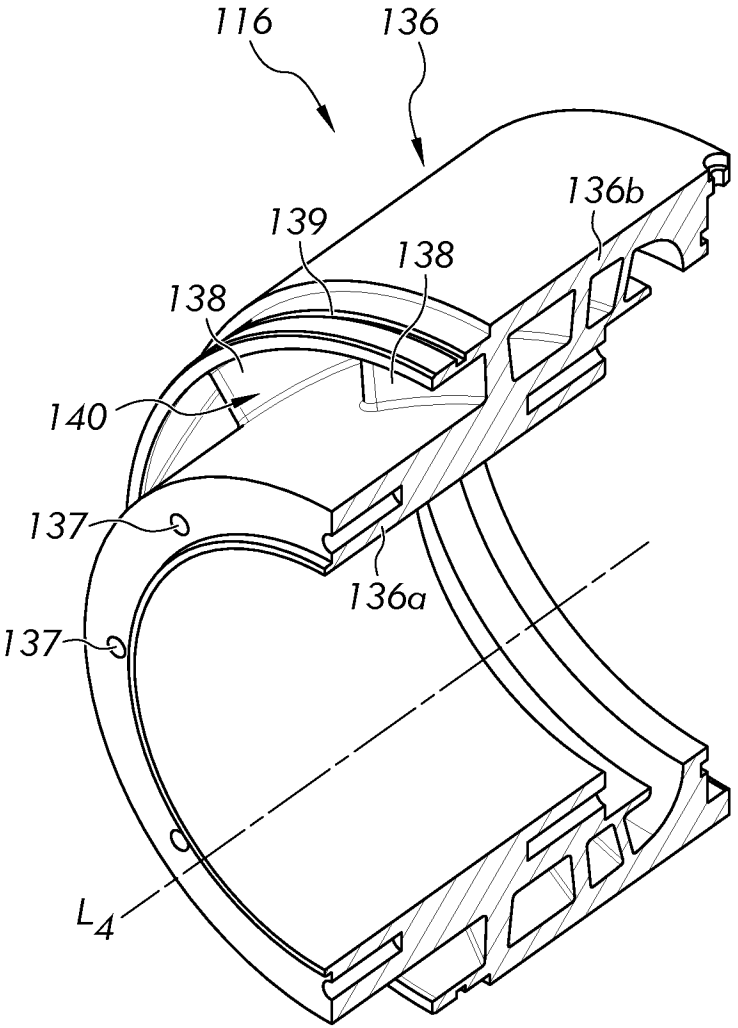
FIG. 4B is a different perspective, cross-sectional view of the second casing shown in FIG. 4A.
Figure 4A:
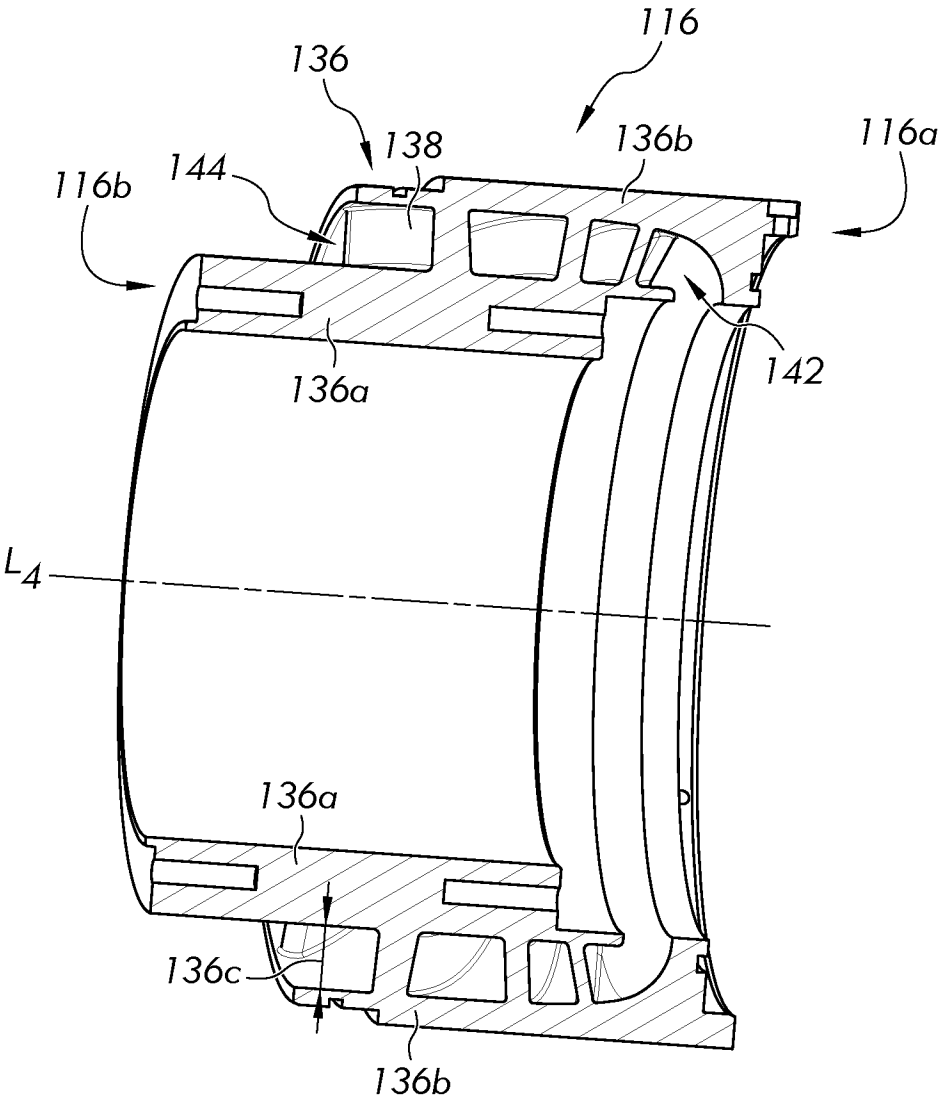
FIG. 4A is a perspective, cross-sectional view of a second casing of the diffuser casing of the multi-stage pump shown in FIG. 1.

As mentioned above, the diffuser casing 104 includes the first casing 114 and the second casing 116. As illustrated in FIG. 6, the second casing 116 is positioned to mate with the first casing 114. Moving now to FIGS. 4A and 4B, the second casing 116 takes the form of a generally hollow cylinder (only a half section of the second casing 116 is illustrated in FIGS. 4A and 4B). However, it is to be understood that the geometric form of the second casing 116 is not limited thereto, and that the second casing 116 may be shaped in any geometric configuration. The second casing 116 includes a circumferential wall 136 extending longitudinally along a fourth longitudinal axis $L_4$ from a first end 116*a* to a second end 116*b* thereof. When the second casing 116 is positioned in the outer housing 102, the fourth longitudinal axis $L_4$ is positioned to coaxially align with the first longitudinal axis $L_1$ (as shown in FIG. 1). As further shown, the circumferential wall 136 includes an inner wall 136*a* separated and spaced apart from an outer wall 136*b* such that a gap 136*c* is formed therebetween. That is, the outer wall 136*b* is spaced radially outwards from the inner wall 136*a*.

A plurality of second vanes 138 are positioned within the gap 136*c* and are spaced apart from each other to define a plurality of second internal passages 140 through which fluid flows from an annular second inlet 142 to a peripheral second outlet 144. Specifically, the second vanes 138 extend in a curved manner about the fourth longitudinal axis $L_4$. The second vanes 138 extend between the inner wall 136*a* and the outer wall 136*b* of the circumferential wall 136. As shown, the plurality of second vanes 138 are spaced apart, one from the other, to define the plurality of second internal passages 140 within the gap 136*c*. Specifically, the second internal passage 140 is defined between a pair of adjacent second vanes 138. In this manner, the plurality of second internal passages 140 are positioned within the circumferential wall 136 of the second casing 116 and are spaced circumferentially, one from the other, therein via the plurality of second vanes 138. The second casing 116 is configured to intake fluid (via the annular second inlet 142) in the radial direction R and direct the fluid in the axial direction (i.e., along the fourth longitudinal axis $L_4$) via the second internal passage 140 to the peripheral second outlet 144.

The inner wall 136*a* may include a plurality of mounting holes 137 that are positioned and dimensioned to align with the mounting holes 133 of the first casing 114. In this respect, the first casing 114 and the second casing 116 may be secured together using fastening elements (e.g., bolts 141, shown in FIG. 6). The outer wall 136*b* of the second casing 116 may include one or more annular grooves 139 on an outer cylindrical surface of the outer wall 136*b*. The annular grooves 139 may be dimensioned to receive seal elements, e.g., O-rings (not shown), for allowing the second casing 116 to sealingly engage an inner surface of the inner wall 118*a* of the first casing 114.

It is to be understood that any number of second vanes 138 can be disposed within the gap 136*c* of the second casing 116 so long as at least one second internal passage 140 is defined therein. It is further to be understood that an entirety of the second casing 116 may be formed integrally, as a single piece-part or manufactured from a plurality of discrete parts. Moreover, it is to be understood that the second vanes 138 may have a specific configuration that reduces the dynamic pressure of the fluid while increasing the static pressure of fluid flowing through the second internal passages 140.

Figure 5:
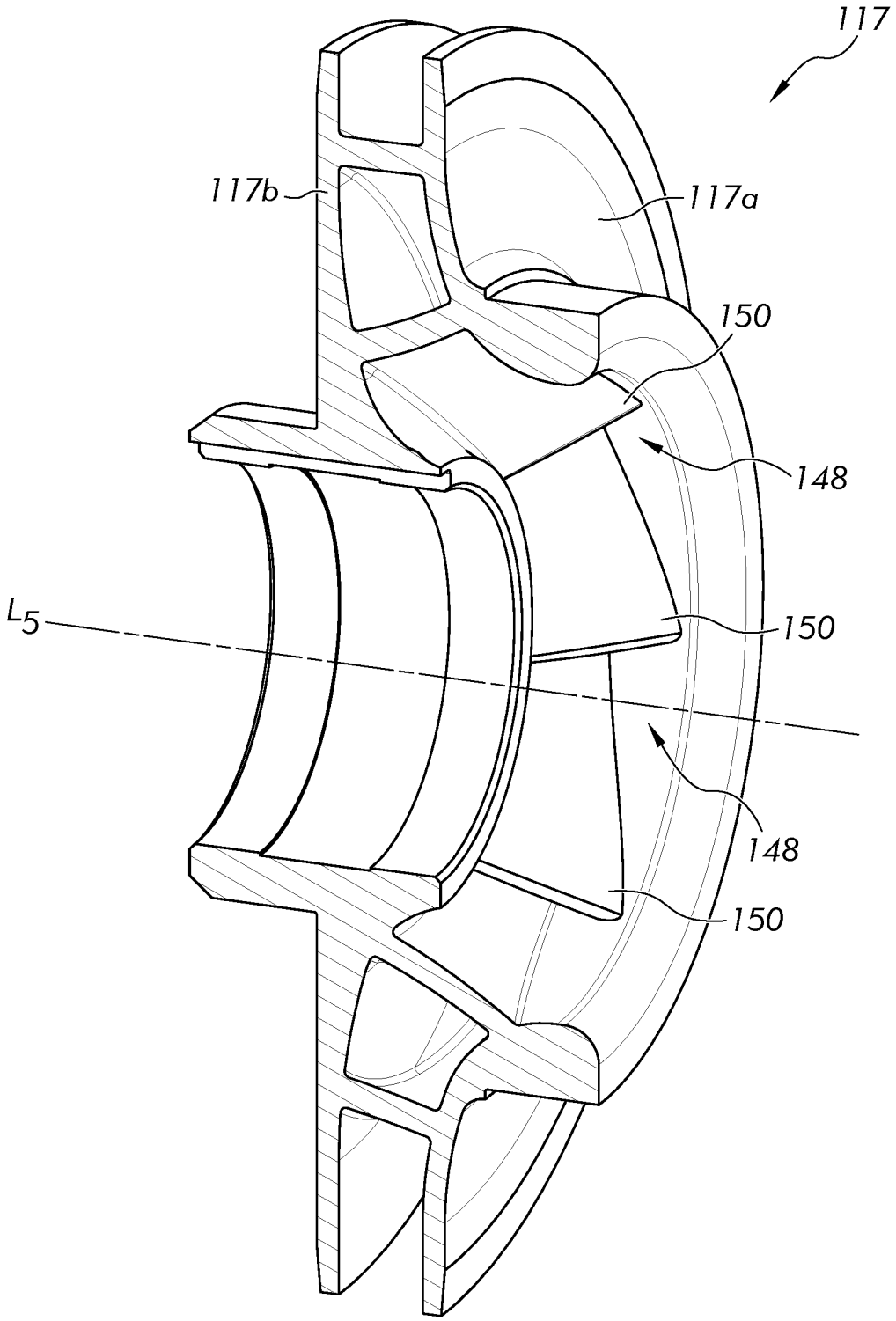
FIG. 5 is a perspective, cross-sectional view of a second impeller shown in FIG. 1.

Moving now to FIG. 6, the outlet impeller 117 of the second set of pump stages 108 is disposed adjacent the first end 116*a* of the second casing 116. As shown in FIG. 5, the outlet impeller 117 of the second set of pump stages 108 is similar in most respects to the outlet impeller 115 of the first set of pump stages 106. The outlet impeller 117 includes a first wall 117*a* and a separate second wall 117*b*. The first and second walls 117*a*, 117*b* are spaced apart from each other to define a channel 148 therebetween. A plurality of blades 150 are disposed within the channel 148 and extend in a curved manner about a fifth longitudinal axis $L_5$. When the outlet impeller 117 is positioned in the outer housing 102, the fifth longitudinal axis $L_5$ of the outlet impeller 117 coaxially aligns with the first longitudinal axis $L_1$ (as shown in FIG. 1). As will be further detailed below, the plurality of blades 150 of the outlet impeller 117 of the second set of pump stages 108 is configured to intake fluid in an axial direction (i.e., along the fifth longitudinal axis $L_5$) and exhaust the fluid in the radial direction R via the channel 148.

As further shown, the plurality of blades 150 are disposed within the channel 148. The overall number of blades 150 of the outlet impeller 117 of the second set of pump stages 108 may be any number. It is to be understood that the entirety of the outlet impeller 117 of the second set of pump stages 108 may be formed integrally, as a single piece-part or manufactured from a plurality of components that are joined together.

Moving back to FIG. 1, the first set of pump stages 106 includes an inlet pump stage 106*a* and an outlet pump stage 106*b* with at least one intermediate pump stage 106*c* disposed therebetween. The inlet pump stage 106*a* is disposed at the first end 110*a* of the outer housing 102 and the outlet pump stage 106*b* is disposed adjacent the first casing 114 of the diffuser casing 104 (e.g., directly adjacent to the first end 114*a* of the first casing 114). Each of the inlet pump stage 106*a* and the at least one intermediate pump stage 106*c* includes an impeller that is peripherally surrounded by a pump stage housing. For example, the inlet pump stage 106*a* includes an inlet impeller 107*a* peripherally surrounded by an inlet pump stage housing 109*a* and the at least one intermediate pump stage 106*c* includes an intermediate impeller 107*b* peripherally surrounded by an intermediate pump stage housing 109*b*. The outlet pump stage 106*b* includes the outlet impeller 115 which is peripherally surrounded by the first casing 114 of the diffuser casing 104.

The inlet impeller 107*a* is configured to intake fluid in an axial direction (i.e., along the first longitudinal axis $L_1$) and exhaust the fluid in the radial direction R to the inlet pump stage housing 109*a*. The inlet pump stage housing 109*a* then directs the fluid in the axial direction (i.e., along the first longitudinal axis $L_1$) to the intermediate impeller 107*b*. The intermediate impeller 107*b* intakes the fluid and exhausts the fluid in the radial direction R to the intermediate pump stage housing 109*b*. The fluid continues to be directed in this manner to any subsequent pump stages until the fluid is received by the outlet pump stage 106*b*, which will be further discussed below.

Similar to the first set of pump stages 106, the second set of pump stages 108 includes an inlet pump stage 108*a* and an outlet pump stage 108*b* with at least one intermediate pump stage 108*c* disposed therebetween. The inlet pump stage 108*a* is disposed at the second end 110*b* of the outer housing 102 and the outlet pump stage 108*b* is disposed adjacent the second casing 116 of the diffuser casing 104 (e.g., directly adjacent to the first end 116*a* of the second casing 116). Each of the inlet pump stage 108*a* and the at least one intermediate pump stage 108*c* includes an impeller that is peripherally surrounded by a pump stage housing. For example, the inlet pump stage 108*a* includes an inlet impeller 111*a* peripherally surrounded by an inlet pump stage housing 113*a* and the at least one intermediate pump stage 108*c* includes an intermediate impeller 111*b* peripherally surrounded by an intermediate pump stage housing 113*b*. The outlet pump stage 108*b* includes the outlet impeller 117 which is peripherally surrounded by the second casing 116 of the diffuser casing 104.

The inlet impeller 111*a* is configured to intake fluid in an axial direction (i.e., along the first longitudinal axis $L_1$) and exhaust the fluid in the radial direction R to the inlet pump stage housing 113*a*. The inlet pump stage housing 113*a* then directs the fluid in the axial direction (i.e., along the first longitudinal axis $L_1$) to the intermediate impeller 111*b*. The intermediate impeller 111*b* intakes the fluid and exhausts the fluid in the radial direction R to the intermediate pump stage housing 113*b*. The fluid continues to be directed in this manner to any subsequent pump stages until the fluid is received by the outlet pump stage 108*c*, which will be further discussed below.

The total number of pump stages in each of the first and second sets of pump stages 106, 108 is not limited to a specific number. That is, the first and second sets of pump stages 106, 108 may each include any number of pump stages so long as the first set of pump stages 106 includes the outlet pump stage 106*b* and the second set of pump stages 108 includes the outlet pump stage 108*b*.

The multi-stage pump 100 further includes a shaft 152 disposed within the inner space of the outer housing 102 and extending longitudinally therein. The shaft 152 is configured to rotate about the first longitudinal axis $L_1$. Specifically, the shaft 152 may be operatively connected to a motor (not shown) that rotatably drives the shaft 152. Moreover, the outlet impellers 115, 117 of the first and second sets of pump stages 106, 108, respectively, are connected (e.g., secured) to the shaft 152 such that as the shaft 152 rotates, the outlet impellers 115, 117 likewise rotate therewith. Moreover, the diffuser casing 104 is shaped and configured to house a bearing support 151 therein. Specifically, as shown in FIG. 6, the second casing 116 of the diffuser casing 104 peripherally surrounds the bearing support 151. However, it is to be understood that other configurations are contemplated.

That is, the bearing support 151 need not be peripherally surrounded by the second casing 116 of the diffuser casing 104. The bearing support 151 supports bearings that promote smooth rotational movement of the shaft 152.

Further still, the multi-stage pump 100 is configured such that the first casing 114 is separate and distinct with respect to the second casing 116. That is, the first casing 114 is an individual piece-part that is manufactured separately from the second casing 116. In this manner, if one of the first and second casings 114, 116 is damaged, then only the damaged casing needs to be replaced (as opposed to the entire diffuser casing 104). However, in alternative embodiments, the first and second casings 114, 116 of the diffuser casing 104 may be formed integrally together as a single-piece part. Moreover, the multi-stage pump 100 is configured such that the first and second casings 114, 116 of the diffuser casing 104 are stationary with respect to the outlet impellers 115, 117. That is, as the outlet impellers 115, 117 rotate about the first longitudinal axis $L_1$ (via the shaft 152), the first and second casings 114, 116 remain stationary (i.e., not moving in a rotational direction or in a translation direction with respect to the first longitudinal axis $L_1$).

Moving again to FIG. 6, as depicted, the first and second casings 114, 116 are disposed directly adjacent to one another in order to form the diffuser casing 104. In particular, the third longitudinal axis $L_3$ of the first casing 114 is coaxially aligned with the fourth longitudinal axis $L_4$ of the second casing 116. Fasteners 141 may be provided for securing the first casing 114 to the second casing 116 through the mounting holes 133, 137 of the first and second casings 114, 116, respectively. The diffuser casing 104 is configured such that the first casing 114 extends radially (i.e., in the radial direction R) beyond the second casing 116. That is, the first casing 114 is dimensioned such that the circumferential wall 118 thereof has a larger radius (from the first longitudinal axis $L_1$) than that of the circumferential wall 136 of the second casing 116. Specifically, the inner wall 118*a* of the first casing 114 has substantially the same radius as that of the outer wall 136*b* of the second casing 116, and the outer wall 118*b* of the first casing 114 has a larger radius (from the first longitudinal axis $L_1$) than that of the inner wall 118*a* of the first casing 114. In this manner, as will be detailed further below, the first outlet 126 of the first casing 114 exhausts fluid radially outside of the second casing 116.

The fluid exhausted from the first casing 114 is directed (downstream) to the reservoir 112 via a bridge member 154. The bridge member 154 is shown in the form of a cylinder and is positioned such that the bridge member 154 is disposed on and peripherally surrounds the second casing 116. Specifically, the bridge member 154 is disposed on the outer wall 136*b* of the second casing 116. The bridge member 154 may be formed in any geometric shape permitted by the dimensions of the outer housing 102. Further, the bridge member 154 includes vanes 155 configured to direct the fluid to the reservoir 112. The vanes 155 further provide structural support for the bridge member 154, thereby ensuring a proper seal between the diffuser casing 104 and the inner surface 102*b* of the outer housing 102 (e.g., provided via an O-ring, not shown). Moreover, the bridge member 154 is shown as being a separate and distinct element with respect to the diffuser casing 104. However, the bridge member 154 may be formed integral with the first casing 114 and/or the second casing 116.

As further shown, the first casing 114 and the second casing 116 define a chamber 156 therebetween. For example, in the depicted embodiment, the inner wall 136*a* of the second casing 116 is peripherally surrounded by inner wall 118*a* of the first casing 114. In this manner, the first and second casings 114, 116 define the chamber 156 therebetween. It is to be understood that the chamber 156 is not limited to being defined in the aforementioned manner. That is, the chamber 156 may be defined entirely in the first casing 114 or the second casing 116. The chamber 156 is in direct fluid communication with the second internal passage 140 of the second casing 116 and the through-holes 128 in the first casing 114. In this manner, as will be further detailed below, fluid is directed from the second internal passage 140 of the second casing 116 to a downstream location (i.e., outside of the diffuser casing 104) in the radial direction R via the chamber 156 and the through-holes 128.

The functionality of the multi-stage pump 100 will now be discussed in detail with reference to a method for transferring pressurized fluid within the multi-stage pump 100. With respect to FIG. 1, a fluid enters the multi-stage pump 100 from the first end 110*a* of the outer housing 102. The fluid is directed to the first set of pump stages 106 wherein the fluid enters the inlet pump stage 106*a*. The fluid is directed from the inlet pump stage 106*a* to the outlet pump stage 106*b*, as detailed and described above. As understood by those skilled in the art, the impellers of each stage of the first set of pump stages 106 are configured to successively increase the pressure of the fluid as it flows from the inlet pump stage 106*a* to the outlet pump stage 106*b*. With respect to FIG. 6, when the fluid reaches the outlet pump stage 106*b*, the fluid is directed along a first flow path P1 wherein the fluid enters the channel 119 of the outlet impeller 115 (as shown in FIG. 2) and is directed (in the radial direction R) to the first internal passage 122 formed in the first casing 114. Specifically, as the outlet impeller 115 rotates (via the shaft 152) the blades 121 (shown in FIG. 2) forcefully direct the fluid to the first internal passage 122 of the first casing 114.

Once in the first internal passage 122, the fluid is conveyed along a second flow path P2 from the first internal passage 122 (via the first outlet 126, shown in FIG. 3A) of the first casing 114 and is directed to the reservoir 112 via the bridge member 154. The fluid enters the reservoir 112 and continues to be directed in the first direction D1 until the fluid reaches the second end 110*b* of the outer housing 102 where the fluid enters the second set of pump stages 108 (see FIG. 1).

When the fluid reaches the second set of pump stages 108, the fluid enters the inlet pump stage 108*a* and is directed therefrom to the outlet pump stage 108*b*, as detailed and described above. As understood by those skilled in the art, the impellers of each stage of the second set of pump stages 108 are configured to successively increase the pressure of the fluid as it flows from the inlet pump stage 108*a* to the outlet pump stage 108*b*. When the fluid reaches the outlet pump stage 108*b*, the fluid is directed along a third flow path P3 wherein the fluid enters the channel 148 of the outlet impeller 117 (as shown in FIG. 5) and is directed (in the radial direction R) to the second internal passage 140 formed in the second casing 116. Specifically, as the outlet impeller 117 rotates (via the shaft 152) the blades 150 forcefully direct the fluid back to the diffuser casing 104, and more specifically, into the second internal passage 140.

The fluid exhausted from the outlet impeller 117 enters the second internal passage 140 of the second casing 116 (via the second inlet 142, shown in FIG. 4A). The fluid is directed along a fourth flow path P4 through the second internal passage 140 and is exhausted therefrom into the chamber 156 (via the second outlet 144 of the second casing 116, shown in FIG. 4A). From the chamber 156 the fluid is expelled from the diffuser casing 104 in the radially outward direction R. Specifically, the fluid received in the chamber 156 is directed along a fifth flow path P5 to a downstream location (i.e., outside of the diffuser casing 104) via the through-hole 128 in the first vane 120. As briefly mentioned above, the through-hole 128 extends through the first vane 120 in a manner such that the through-hole 128 is not in fluid communication with the gap 118*c* defined between the inner and outer walls 118*a*, 118*b* of the first casing 114. In this manner, the first casing 114 of the diffuser casing 104 provides two separate fluid paths (i.e., the first flow path P1 and the fifth flow path P5) wherein flow along the first flow path P1 is in an axial direction to convey fluid from an outlet of a first set of pump stages to an inlet of a second set of pump stages, and the fifth flow path P5 conveys fluid exiting the second set of pump stages in a radial direction so that the fluid may exit the multi-stage pump 100.

More specifically, the aforementioned multi-stage pump 100 permits a fluid to enter the outer housing 102 and be directed (in the first direction D1) from the first end 110*a* thereof to the diffuser casing 104 (located at the central portion of the outer housing 102) via the first set of pump stages 106. The fluid then exits the diffuser casing 104 and is directed to the second set of pump stages 108 (via the reservoir 112). The fluid is then directed (in the second direction D2) back to the diffuser casing 104 where the fluid enters the chamber 156. The fluid is then subsequently gathered in a cavity outside of the diffuser casing to be exhausted from the multi-stage pump 100. In this manner, a downstream path of the fluid (i.e., the fifth flow path P5) essentially crosses over an upstream path of the fluid (i.e., the first flow path P1) via the through-hole 128. As such, the fluid is efficiently directed through the multi-stage pump 100 in a manner entirely internal thereto. That is, no additional parts are required to externally route the fluid from one location to another (e.g., from the first set of pump stages 106 to the second set of pump stages 108).

Furthermore, the configuration of the diffuser casing 104 permits an efficient collection and transmission of fluid from the first set of pump stages 106 to the second set of pump stages 108 and from the second set of pump stages 108 to a downstream location disposed outside of the diffuser casing 104. Specifically, the geometric configuration and number of first vanes 120 of the first casing 114 collects the fluid being exhausted from the first set of pump stages 106 such that the pressure of the fluid builds (i.e., increases) therein. That is, the first vanes 120 and the reservoir 112 are configured to convert the dynamic pressure imparted to the fluid by the first set of pump stages 106 into static pressure.

Moreover, the geometric configuration and number of second vanes 138 of the second casing 116 and the chamber 156 are configured to convert the dynamic pressure imparted to the fluid by the second set of pump stages 108 into static pressure. In this manner, the configuration of the second casing 116 provides the technical advantage of fluid pressure not being lost as the fluid is directed from the second set of pump stages 108 to a downstream location (i.e., outside of the diffuser casing 104).

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A multi-stage pump comprising:

a first set of pump stages directing fluid in a first direction from a first end of the multi-stage pump to a diffuser casing disposed at a central portion of the multi-stage pump;

a second set of pump stages directing the fluid expelled from the diffuser casing in a second direction, opposite to the first direction, from a second end of the multi-stage pump to the diffuser casing; and the diffuser casing comprising:

a first inlet that receives the fluid directed from the first set of pump stages, a first outlet that expels the fluid received by the first inlet toward the second end of the multi-stage pump, a first vane disposed in a first internal passage extending from the first inlet to the first outlet, and a chamber, wherein the diffuser casing receives the fluid from the first set of pump stages and directs the fluid toward the second end of the multi-stage pump and receives the fluid from the second set of pump stages within the chamber and directs the fluid in a radially outward direction with respect to a longitudinal axis of the multi-stage pump, and wherein a through-hole extends through the first vane, and wherein the through-hole directs the fluid in the radially outward direction and expels the fluid received in the chamber to an outside of the diffuser casing.

2. The multi-stage pump of claim 1, wherein the first direction and the second direction are parallel to the longitudinal axis.

3. The multi-stage pump of claim 1, wherein the diffuser casing has a second inlet that receives the fluid directed from the second set of pump stages, and a second outlet that directs the fluid to the chamber within the diffuser casing.

4. The multi-stage pump of claim 3, wherein the diffuser casing comprises a second vane disposed in a second internal passage extending from the second inlet to the second outlet.

5. The multi-stage pump of claim 3, wherein the diffuser casing comprises a first casing that is separate and distinct from a second casing.

6. The multi-stage pump of claim 5, wherein the chamber is defined by both the first casing and the second casing.

7. The multi-stage pump of claim 5, wherein the first casing extends radially beyond the second casing.

8. The multi-stage pump of claim 1, further comprising an outer housing that encases the first set of pump stages, the second set of pump stages, and the diffuser casing.

9. The multi-stage pump of claim 8, wherein a reservoir is defined as a space between an inner surface of the outer housing and an outer surface of the second set of pump stages, and wherein the reservoir directs the fluid expelled from the first outlet to the second end of the multi-stage pump.

10. The multi-stage pump of claim 1, wherein each of the first set of pump stages and the second set of pump stages comprises an outlet pump stage comprising an outlet impeller being rotatable and having blades configured to drive the fluid.

11. The multi-stage pump of claim 10, further comprising a shaft configured to rotate about the longitudinal axis, wherein the outlet impeller of the first set of pump stages and the outlet impeller of the second set of pump stages are rotatable via the shaft about the longitudinal axis.

12. The multi-stage pump of claim 10, wherein the diffuser casing peripherally surrounds the outlet impeller of the first set of pump stages and the outlet impeller of the second set of pump stages, and wherein the diffuser casing is stationary with respect to the outlet impeller of the first set of pump stages and the outlet impeller of the second set of pump stages.

13. A multi-stage pump comprising:

an outer housing integrally formed as a hollow body having an inlet and an outlet;

a first set of pump stages disposed at a first end of the outer housing for directing fluid in a first direction from the inlet of the outer housing to a central portion of the outer housing;

a second set of pump stages disposed at a second end of the outer housing, the second end being opposite to the first end of the outer housing, the second set of pump stages directing the fluid in a second direction, opposite to the first direction, from the second end of the multi-stage pump to the central portion of the outer housing; and a diffuser disposed in the central portion of the outer housing at a location between the first set of pump stages and the second set of pump stages, the diffuser comprising:

an outer circumferential passage extending in a longitudinal direction through the diffuser for directing fluid in the longitudinal direction from an outlet end of the first set of pump stages to an inlet end of the second set of pump stages, and an inner passage extending in a radial direction through the diffuser for directing fluid exiting an outlet end of the second set of pump stages in a direction tangential to the direction fluid flows through the outer circumferential passage wherein the fluid flowing in the inner passage is directed radially away from the diffuser, wherein the outer housing is separate from the first set of pump stages and the second set of pump stages, wherein a reservoir is defined as a space between an inner surface of the outer housing and an outer surface of the second set of pump stages, and wherein the reservoir directs the fluid expelled from the outer circumferential passage of the diffuser to the inlet end of the second set of pump stages.

14. The multi-stage pump of claim 13, wherein a vane is disposed within the outer circumferential passage.

15. The multi-stage pump of claim 14, wherein a through-hole is formed in the vane, the through hole defining at least a portion of the inner passage extending in the radial direction through the diffuser.

16. A multi-stage pump comprising:

a first set of pump stages directing fluid in a first direction from a first end of the multi- stage pump to a central portion of the multi-stage pump, wherein the first direction is parallel to a longitudinal axis of the multi-stage pump;

a second set of pump stages directing the fluid in a second direction, opposite to the first direction, from a second end of the multi-stage pump to the central portion;

a diffuser casing disposed at the central portion and having a first inlet that receives the fluid directed from the first set of pump stages, a first outlet that expels the fluid received by the first inlet, a second inlet that receives the fluid directed from the second set of pump stages, and a second outlet that directs the fluid to a chamber within the diffuser casing; and an outer housing that encases the first set of pump stages, the second set of pump stages, and the diffuser casing, wherein the diffuser casing further comprises a first casing and a second casing, the first casing having a first vane that defines a first internal passage from the first inlet to the first outlet, and the second casing having a second vane that defines a second internal passage from the second inlet to the second outlet, wherein a through-hole is formed in the first vane, and wherein the through-hole directs the fluid in a radial direction with respect to the longitudinal axis of the multi-stage pump and expels the fluid received in the chamber to an outside of the diffuser casing, and wherein a reservoir is defined as a space between an inner surface of the outer housing and an outer surface of the second set of pump stages, and wherein the reservoir directs the fluid expelled from the first outlet to the second end of the multi-stage pump.

* * * * *